US005444984A

United States Patent [19]

Carson

[11] Patent Number: 5,444,984

[45] Date of Patent: Aug. 29, 1995

[54] STORAGE CABINET WITH ACTIVE DEHUMIDIFIER

[76] Inventor: Steven D. Carson, 12817 Chandler, Omaha, Nebr. 68138

[21] Appl. No.: 241,301

[22] Filed: May 10, 1994

[51] Int. Cl.[6] ..... F25B 21/02

[52] U.S. Cl. ..... 62/3.4; 62/3.6

[58] Field of Search ..... 62/3.4, 3.6, 3.2

[56] References Cited

U.S. PATENT DOCUMENTS

| | | | |
|---|---|---|---|
| 2,288,285 | 6/1942 | Knight | 62/89 |
| 2,311,425 | 2/1943 | Wild | 62/89 |
| 2,782,607 | 2/1957 | Jacobs | 62/102 |
| 2,954,684 | 10/1960 | Stillman | 62/419 |
| 2,970,449 | 2/1961 | Eichhorn | 62/3.4 X |
| 3,001,380 | 9/1961 | Ramey | 62/261 |
| 3,050,948 | 8/1962 | Jones | 62/3.4 |
| 3,300,990 | 1/1967 | Jaremus | 62/3.6 |
| 4,499,736 | 2/1985 | Lieu et al. | 62/3.4 |
| 4,586,342 | 5/1986 | Morishita et al. | 62/3.4 |
| 5,014,909 | 5/1991 | Yasuo | 62/3.4 X |
| 5,315,830 | 5/1994 | Doke et al. | 62/3.6 X |
| 5,375,421 | 12/1994 | Hsieh | 62/3.4 |

*Primary Examiner*—William E. Tapolcai

*Attorney, Agent, or Firm*—Henderson & Sturm

[57] ABSTRACT

A storage cabinet utilizing an active, solid state dehumidifier to protect items stored therein. A thermoelectric device is sandwiched between a heat exchanger and a heat sink and is secured to the inside panel of the safe door. A control means monitors and regulates the temperature of the heat exchanger to promote condensation of moisture on the heat exchanger while also preventing the moisture from freezing. An air circulation fan cools the heat sink, which also results in a slight increase in the internal temperture of the cabinet, further inhibiting condensation of moisture on the items stored therein.

5 Claims, 6 Drawing Sheets

STORAGE CABINET WITH ACTIVE DEHUMIDIFIER

TECHNICAL FIELD

This invention relates to storage cabinets, and more particularly to cabinets with active dehumidifiers.

BACKGROUND ART

Storage cabinets and safes for firearms, stamps, art work, and other valuable items, are well known in the art, as are products which attempt to reduce corrosion damage that can be caused due to the condensation of moisture on the surface of the items during prolonged storage. Desiccants such as silica gel can be placed inside the cabinet or safe to absorb water from the air. However, these desiccants can become saturated in a relatively short time in a humid environment, and must then be regenerated by heating in an oven for several hours. Chemical rust inhibitor products are also available. These chemicals give off a vapor that "passivates" exposed metals and inhibits corrosion. A final device which is described as a dehumidifier, but is actually a heater, is U.S. Pat. No. 2,511,910. This device is a metal wand that extends to within a firearm safe and generates low heat, thereby raising the temperature in the safe and preventing condensation of moisture on the enclosed firearms.

DISCLOSURE OF THE INVENTION

The present invention discloses a storage cabinet which utilizes an active, solid state dehumidifier to protect valuable items stored therein. A thermoelectric device is sandwiched between a heat exchanger and a heat sink and is secured to the inside panel of the safe door. A control means monitors and regulates the temperature of the heat exchanger to promote condensation of moisture while also preventing the moisture from freezing. An air circulation fan cools the heat sink, which also results in a slight increase in the internal temperture of the safe, further inhibiting condensation of moisture on the items stored therein.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
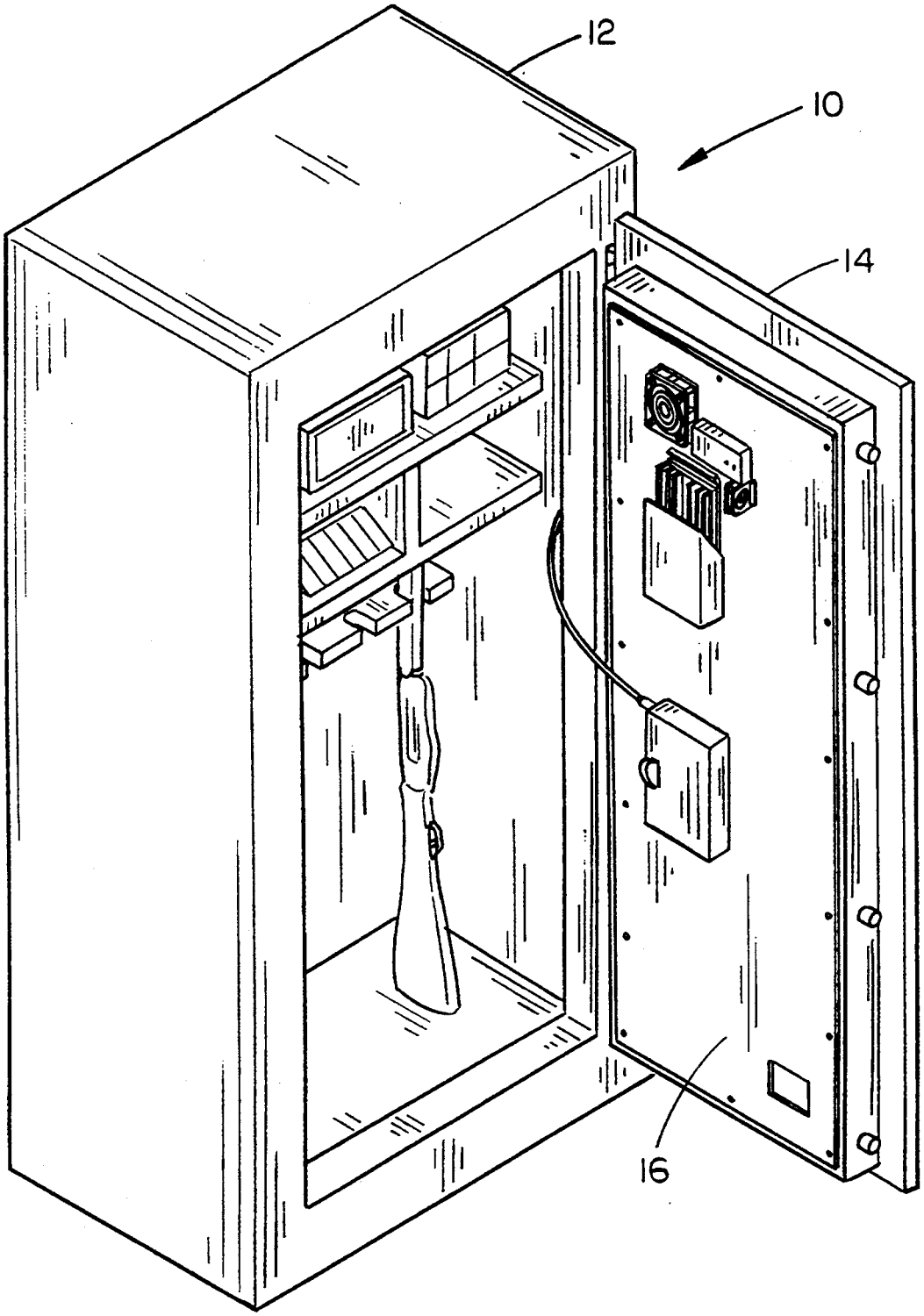
FIG. 1 is a perspective view of a firearm safe encompassing the present invention.
Figure 2:
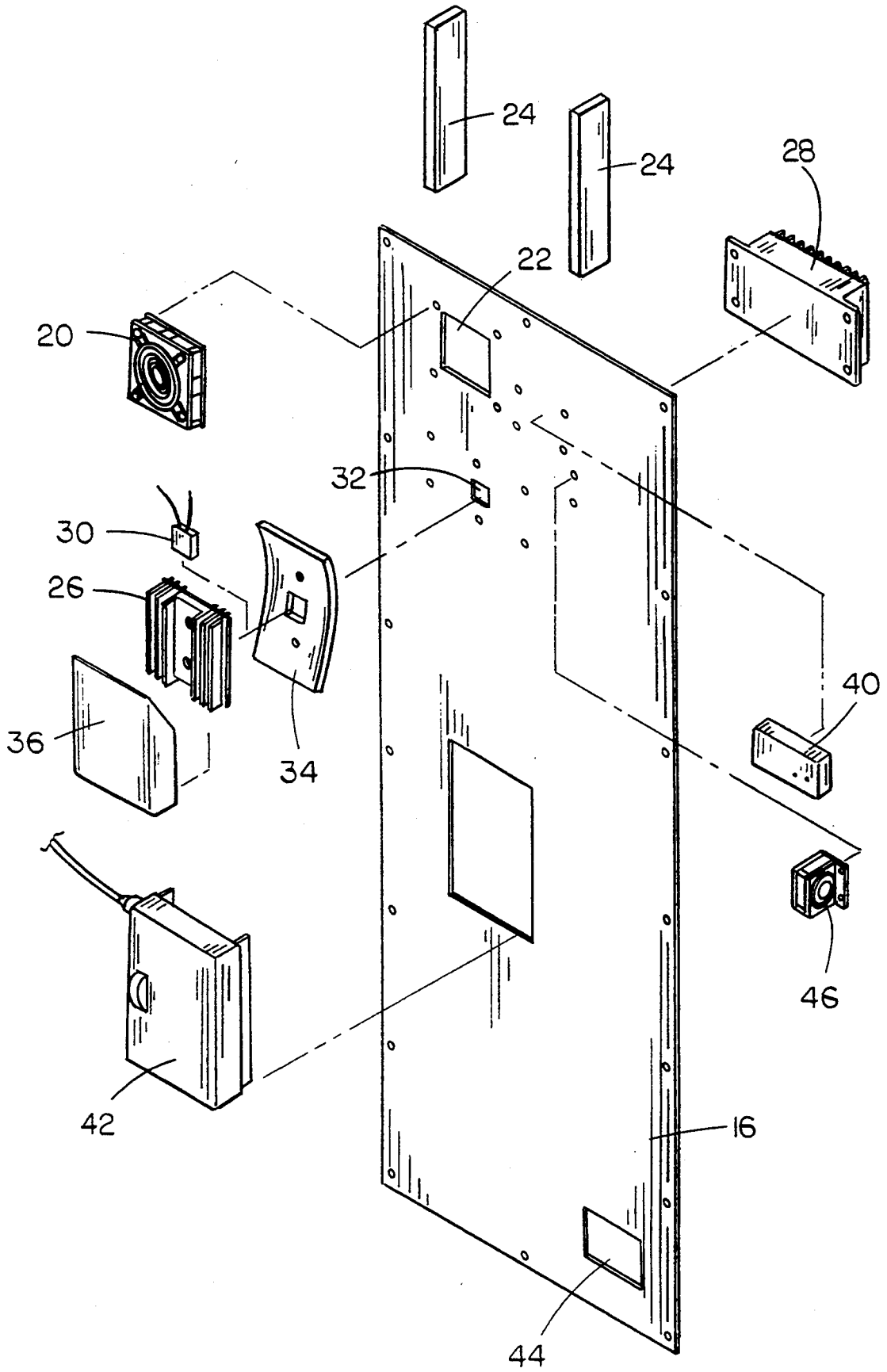
FIG. 2 is an exploded view of the present invention.
Figure 3:
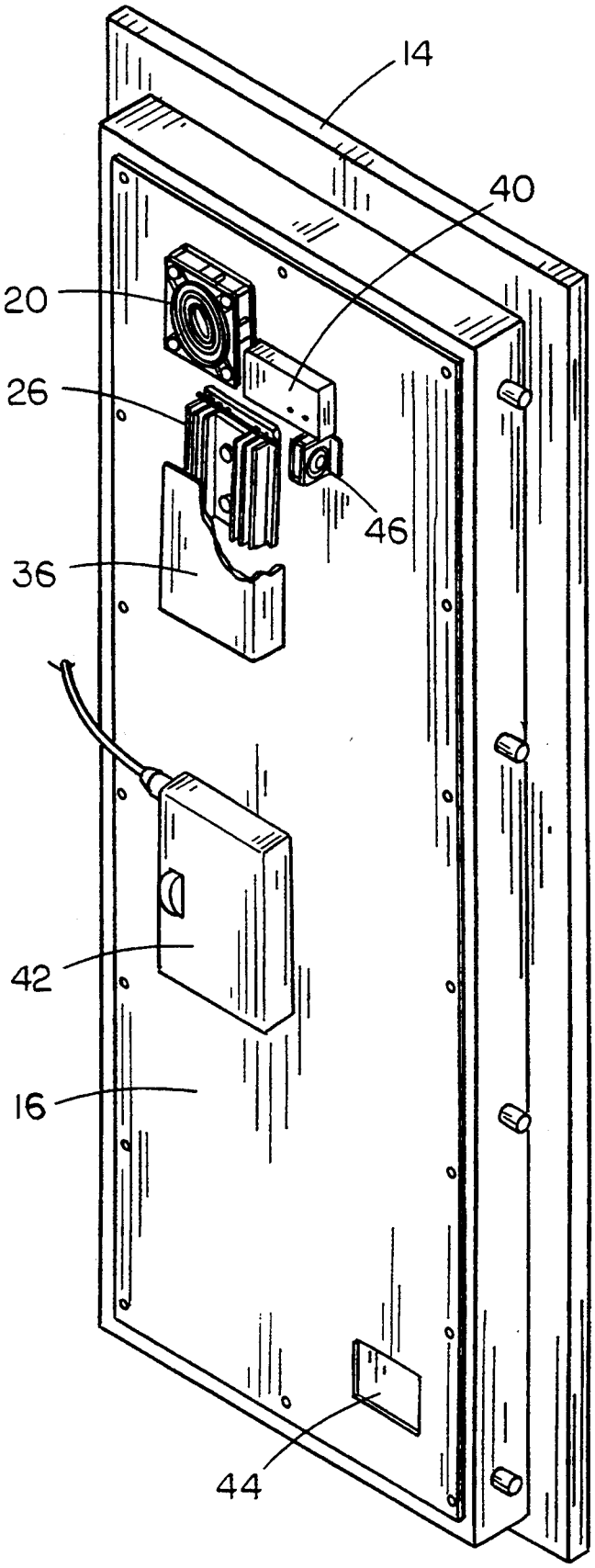
FIG. 3 is a perspective view of the back side of the safe door.
Figure 4:
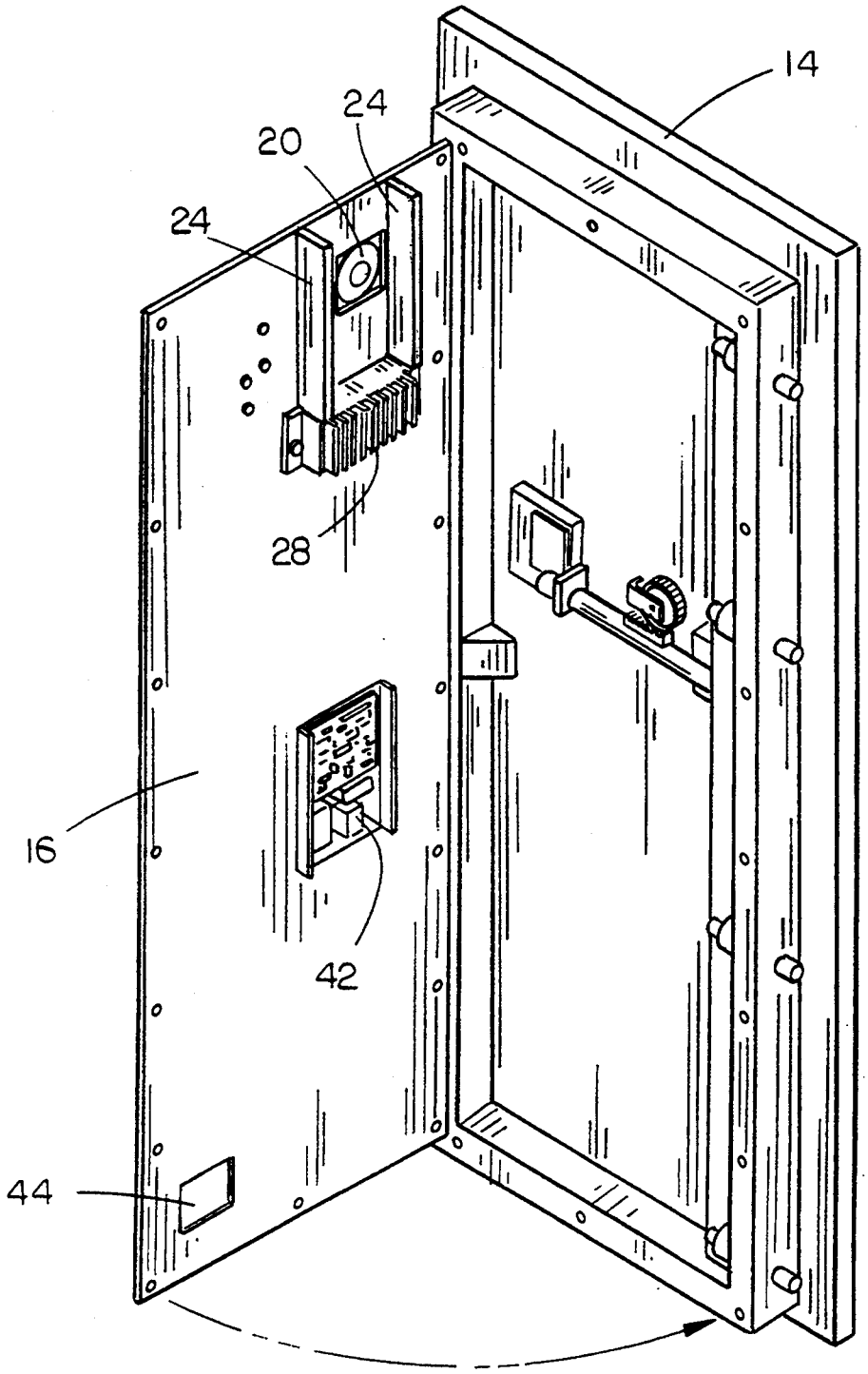
FIG. 4 is a perspective view of the inside of the safe door with the back panel swung into an open position.

Referring now to the drawings, wherein like reference numerals designate identical or corresponding parts throughout the several views, the storage cabinet of the present invention is depicted in FIG. 1 and comprises, for example, a firearm safe 10 having a cabinet portion 12 and a locking door 14. The components of the dehumidifier of the invention are best seen in FIGS. 2, 3, and 4 and include an inside door panel 16 which supports the remaining components. An air circulation fan 20 is secured over an aperture 22 in the door panel and forces air from inside the cabinet 12 and down through the door 14, this air being initially directed by a pair of baffles 24. Just below the air circulation fan 20 is positioned a heat exchanger 26 and heat sink 28, which together sandwich a Peltier effect thermoelectric device 30 within an aperture 32 in the door panel 16. The heat exchanger 26 is thermally isolated from the door panel 16 by means of a sheet of insulating foam 34, whereas the heat sink 28 is in thermal contact with the door panel 16 to effectively increase the size of the heat sink. The heat exchanger 26 receives a fluid reservoir 36 to catch condensate as it drips off of the heat exchanger 26. Obviously, the reservoir 36 must be emptied occasionally or could utilize a drain hose to the exterior of the safe.

The invention further comprises a control unit 40, and a power supply 42, both of which are secured to the door panel 16 as depicted in the Figures. A temperature sensor 48 (shown only in FIG. 6), as for example a thermistor, is placed immediately adjacent the heat exchanger 26 and provides heat exchanger temperature to the control unit 40. The power supply receives electrical power from an external source. An air exhaust port 44 is situated near the lower edge of the door panel 16 which exhausts air from inside the door 14 and into the cabinet 12. Also shown is an auxiliary fan 46, situated adjacent the heat exchanger 26, which may be used in one embodiment of the invention.

Figure 5:
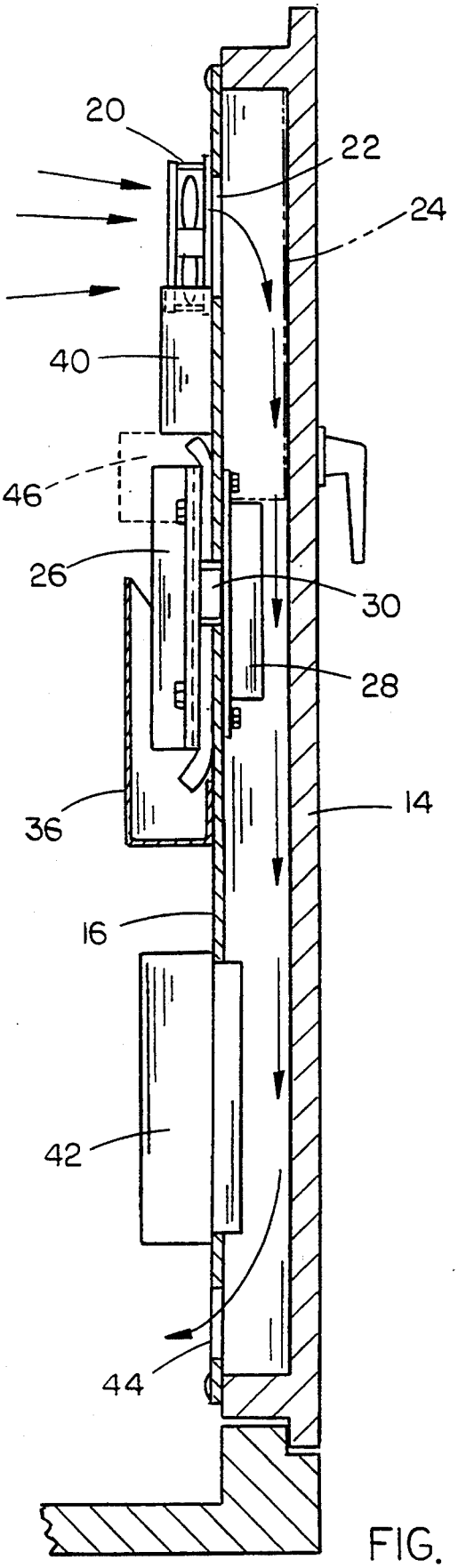
FIG. 5 is a cross sectional view of the safe door.

The invention is shown in cross section in FIG. 5 and depicts the flow of air through the inside of the door 14. Air is drawn by the circulation fan 20 from the interior of the safe to within the door 14 through the fan aperture 22. This air is then directed by the baffles 24 down across the heat sink 28, thereby cooling it. The air continues down through the interior of the door 14, and finally is exhausted back into the safe interior by means of the air exhaust port 44.

Figure 6:
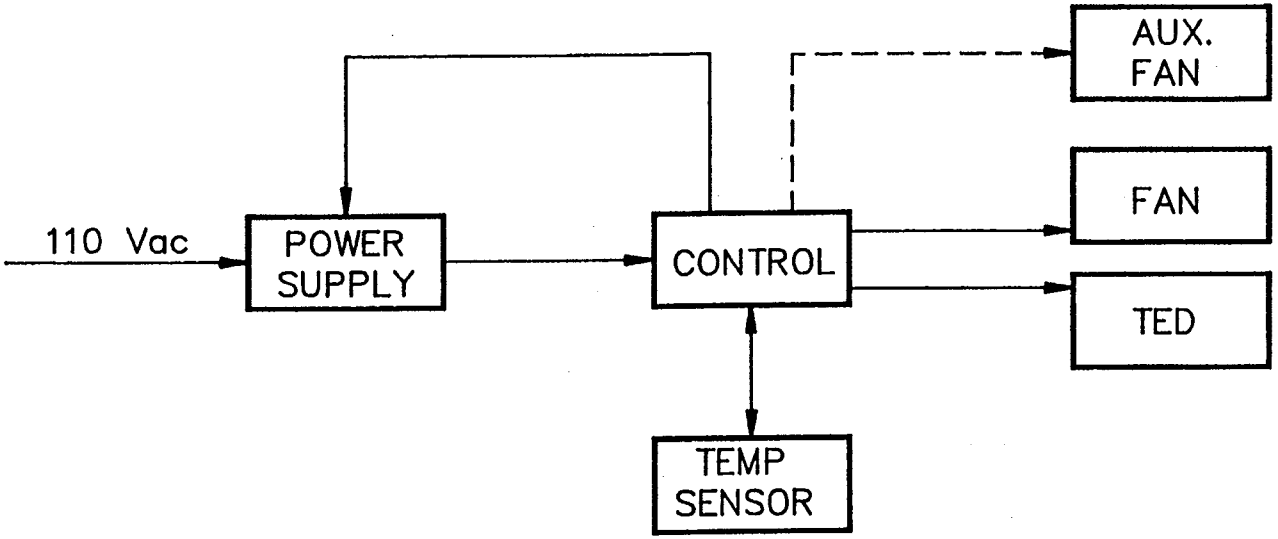
FIG. 6 is a block diagram of the present invention.

Thermoelectric devices utilizing the Peltier effect are well known in the art. A typical thermoelectric device has a thermocouple junction and conductors for passing current through the junction. The junction is housed within a module that has two opposing surfaces in heat communication with the respective sides of the junction so that upon passage of current through the junction there will be a temperature differential between the two opposing surfaces of the module. The cold surface of the module is in thermal contact with the heat exchanger 26 which is thereby cooled to a point where moisture condenses on its surface. The warm surface of the module is in thermal contact with a heat sink 28 for dissipation of heat transferred from the heat exchanger 26. Referring to FIG. 6, the power supply 42 of the present invention functions to convert 110 volt alternating current to a lower voltage direct current compatible with the thermoelectric device 30 and other system components. The power supply 42 also is equipped with a safety relay switch which will turn the power supply off should the temperature sensor 48 detect an excessive heat exchanger temperature rise. Such a situation could occur if the circulation fan 20 would fail. In a first embodiment, the circulation fan 20 receives 12 volts dc and runs continuously. The current passing through the thermoelectric device 30 is regulated by the control unit 40 in response to temperature information from the temperature sensor 48. Ideally, the heat exchanger 26 temperature would be held just above 0° C. to prevent the condensate which collects thereon from freezing. In a second embodiment, the thermoelectric device 30 receives a constant current, with the control unit 40 cycling an auxiliary fan 46 in response to heat exchanger 26 temperature deviation information provided by the temperature sensor 48. In both embodiments, the effectiveness of the invention is further enhanced by the fact that the interior of the safe is warmed slightly by the passing of circulation air over the heat sink. This temperature rise tends to decrease the condensation of moisture on the firearms stored within the safe.

Obviously, many modifications and variations of the present invention are possible in light of the above teachings. If is therefore to be understood that, within the scope of the appended claims, the invention may be practiced otherwise than as specifically described herein.

What is claimed is:

1. A thermoelectrically dehumidified storage cabinet, comprising:

(a) a cabinet having a top and bottom, opposing sides, a back and a hollow door, said hollow door having a front panel and a rear panel;

(b) a solid state dehumidifier having a power supply, a thermoelectric device sandwiched between a heat exchanger and a heat sink, and an air circulation fan; said heat exchanger, thermoelectric device and heat sink affixed to a first aperture in said rear panel of said door, said heat exchanger extending to within said cabinet and said heat sink extending to within said hollow door; said air circulation fan affixed to a second aperture in said rear panel whereby air is forced through said hollow door to cool said heat sink.

2. The invention as recited in claim 1, further comprising means for controlling the temperature of said heat exchanger.

3. The invention as recited in claim 2 wherein said temperature control means comprises a temperature sensor and means for adjusting the current to said thermoelectric device in response to said temperature sensor.

4. The invention as recited in claim 2 wherein said temperature control means comprises a temperature sensor and means for controlling the flow of air across said heat exchanger.

5. The invention as recited in claim 4 wherein said air flow control means comprises an auxiliary fan.

* * * * *